US009149117B2

(12) United States Patent
Gill et al.

(10) Patent No.: US 9,149,117 B2
(45) Date of Patent: Oct. 6, 2015

(54) TOOL CABINET DRAWER AND LATCHING MECHANISM

(71) Applicant: Gill Metal Fabrication, Inc., Brockton, MA (US)

(72) Inventors: Paul L. Gill, West Bridgewater, MA (US); Jason B. Borden, Taunton, MA (US)

(73) Assignee: Gill Metal Fabrication, Inc., Brockton, MA (US)

( * ) Notice: Subject to any disclaimer, the term of this patent is extended or adjusted under 35 U.S.C. 154(b) by 0 days.

(21) Appl. No.: 14/279,696

(22) Filed: May 16, 2014

(65) Prior Publication Data

US 2014/0339974 A1 Nov. 20, 2014

Related U.S. Application Data

(60) Provisional application No. 61/823,989, filed on May 16, 2013.

(51) Int. Cl.
*A47B 95/02* (2006.01)
*A47B 88/04* (2006.01)

(52) U.S. Cl.
CPC ..... *A47B 88/04* (2013.01); *A47B 2095/024* (2013.01)

(58) Field of Classification Search
CPC ... A47B 88/04; A47B 95/02; A47B 2085/024
USPC ..... 312/330.1, 333, 332.1, 319.1, 348.4; 70/85; 292/95, 212, 126, 128, 210
See application file for complete search history.

(56) References Cited

U.S. PATENT DOCUMENTS

| | | | | |
|---|---|---|---|---|
| 6,527,353 | B1 * | 3/2003 | Bradfish et al. | 312/332.1 |
| 6,547,289 | B1 * | 4/2003 | Greenheck et al. | 292/126 |
| 8,608,261 | B2 * | 12/2013 | Retchloff et al. | 312/332.1 |
| 2008/0150407 | A1 * | 6/2008 | Mehmen | 312/332.1 |
| 2010/0019636 | A1 * | 1/2010 | Chen et al. | 312/332.1 |
| 2011/0309730 | A1 * | 12/2011 | Retchloff et al. | 312/332.1 |

* cited by examiner

*Primary Examiner* — James O Hansen
(74) *Attorney, Agent, or Firm* — Maine Cemota & Rardin

(57) ABSTRACT

A tool cabinet drawer and latching mechanism for operating a drawer of a cabinet. The latch pivots within a channel disposed in a handle assembly, which itself pivotally mounts to supports, which are themselves mounted to the drawer. The latch engages with a catch in the cabinet itself to secure the drawer. In some embodiments the latch incorporates a tapered leading edge to allow the catch edges to exert downward force on the latch, which is free to move to an unlatched position, and thereby will automatically latch upon normal closing of the drawer.

18 Claims, 10 Drawing Sheets

TOOL CABINET DRAWER AND LATCHING MECHANISM

RELATED APPLICATIONS

This application claims the benefit of U.S. Provisional Application No. 61/823,989 filed on May 16, 2013. This application is herein incorporated by reference in its entirety for all purposes.

FIELD OF THE INVENTION

The invention relates to latch mechanisms, and, more particularly, to latch mechanisms used on tool cabinet drawers and doors.

BACKGROUND OF THE INVENTION

Existing drawers, particularly those used in tool cabinets, commonly employ latching mechanisms. Although some latching mechanisms are designed to protect against theft, most are designed simply to prevent inadvertent opening of the drawers, especially while relocating the cabinet. Typical latching mechanisms include small components unsuitable for use with gloved hands, require the use of two hands, or are overly complicated and prone to breakage.

What is needed, therefore, is a simple and durable drawer and latch mechanism that can be easily operated by a single gloved hand.

SUMMARY OF THE INVENTION

One embodiment of the present invention provides a sliding drawer assembly including a latch mechanism for securing the drawer, comprising: a cabinet frame; a drawer slidably coupled to the cabinet frame, the drawer having a front wall, a back wall, spaced apart side walls, and at least one shelf secured to and extending between the side walls; at least two supports fixed to the drawer, abutting the drawer's front wall, providing pivotal connections for rotation about an axis substantially parallel with the drawer front; a handle having a channel in rotatable communication with the supports' pivotal connections and a latch contact section extending from the channel, away from the drawer front wall, and substantially parallel to the drawer shelf in an unrotated position; a latch having a pivotal connection, a top portion, and extending substantially parallel to the drawer shelf, the pivotal connection in rotatable communication with the handle's channel and coaxial with the supports' pivotal connection, the top portion of the latch being in communication with the latch contact section; and a catch, disposed in the cabinet frame, able to provide releasable engagement with the latch.

Another embodiment of the present invention provides such a sliding drawer assembly, wherein the latch includes tapered leading ends.

A further embodiment of the present invention provides such a sliding drawer assembly wherein the latch includes curved ends.

Yet another embodiment of the present invention provides such a sliding drawer assembly further comprising a spring member between the front wall and the latch, biasing the handle and the latch towards a closed position.

A yet further embodiment of the present invention provides such a sliding drawer assembly wherein the spring member is selected from the group of spring members comprising preloaded springs, springs, extension springs, polymeric pads or bumpers, tangs, leaf springs.

Even another embodiment of the present invention provides such a sliding drawer assembly wherein the latch incorporates a spring seat facing the front drawer wall.

An even further embodiment of the present invention provides such a sliding drawer assembly further comprising at least two end caps fixed within the handle's channel at opposite ends.

Still another embodiment of the present invention provides such a sliding drawer assembly wherein the end caps are fixed to the handle's channel by threaded fasteners.

A still further embodiment of the present invention provides such a sliding drawer assembly wherein the top section of the latch is substantially flat.

Yet even another embodiment of the present invention provides such a sliding drawer assembly wherein the top section of the latch is curvilinear.

A yet even further wherein the latch top comprises a cam.

One embodiment of the present invention provides a latch system, the latch system comprising: at least two supports providing pivotal connections for rotation about an axis; a handle having a channel in rotatable communication with the supports' pivotal connections and a latch contact section extending from the channel; a latch having a pivotal connection, a top portion, and the pivotal connection in rotatable communication with the handle's channel and coaxial with the supports' pivotal connection, the top portion of the latch being in communication with the latch contact section; and a catch, mounted externally to the latch system, able to provide releasable engagement with the latch.

Another embodiment of the present invention provides such a latch system further comprising tapered leading ends.

A further embodiment of the present invention provides such a latch system further comprising curved leading ends.

Even another embodiment of the present invention provides such a latch system further comprising a spring member biasing the handle and the latch towards a closed position.

An even further embodiment of the present invention provides such a latch system further comprising at least two end caps fixed within the handle's channel at opposite ends.

Still another embodiment of the present invention provides such a latch system wherein the end caps are fixed to the handle's channel by threaded fasteners.

A still further embodiment of the present invention provides such a latch system wherein the latch top comprises a cam.

The features and advantages described herein are not all-inclusive and, in particular, many additional features and advantages will be apparent to one of ordinary skill in the art in view of the drawings, specification, and claims. Moreover, it should be noted that the language used in the specification has been principally selected for readability and instructional purposes, and not to limit the scope of the inventive subject matter.

DETAILED DESCRIPTION

Figure 1A:
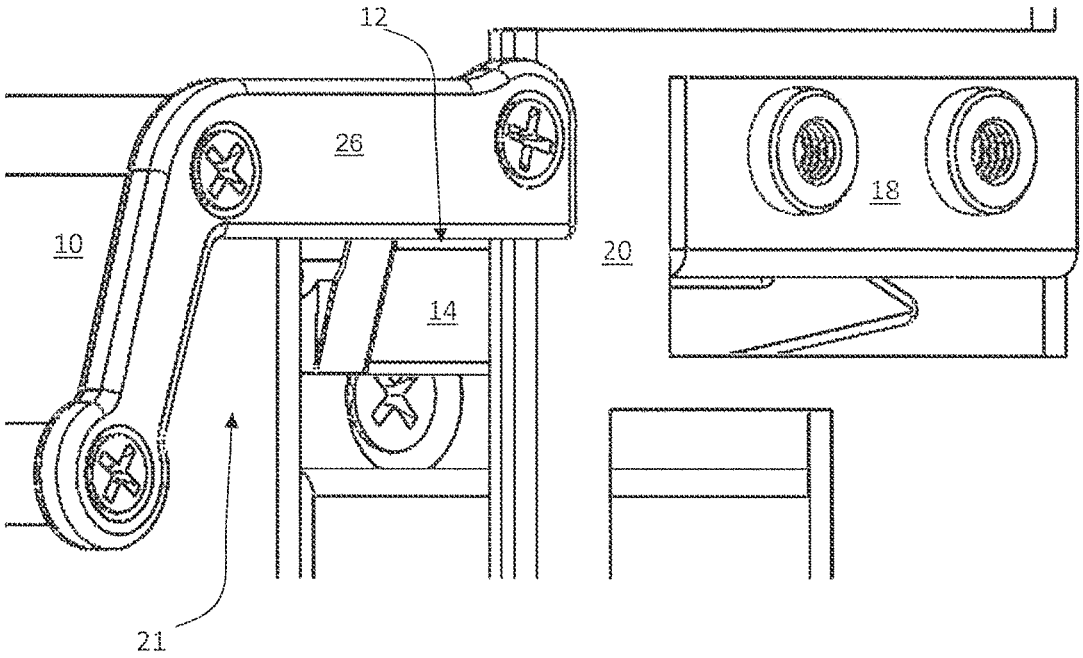
FIG. 1A is a side partial perspective section view of one end of the latching mechanism in a closed position, configured in accordance with one embodiment of the present invention.
Figure 1B:
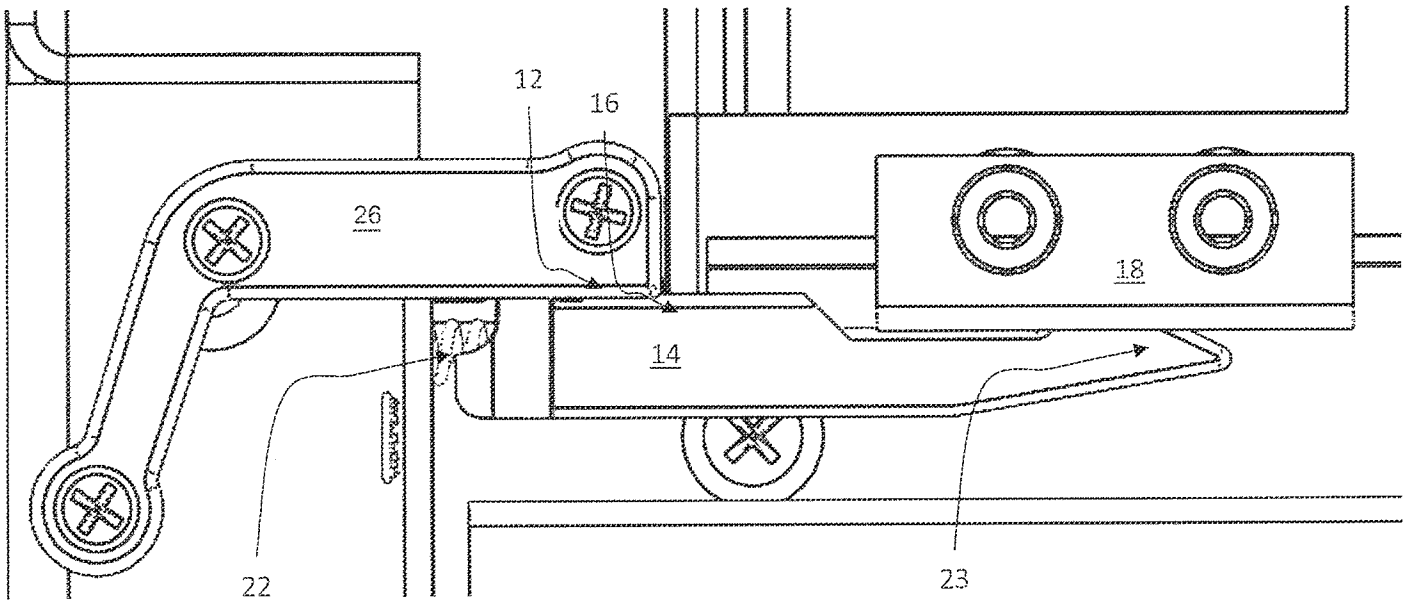
FIG. 1B is a side partial elevation view of one end of the latching mechanism in a closed position, configured in accordance with one embodiment of the present invention.

Referring to FIGS. 1A-1B, the latching mechanism handle 10 has a flat lower section or latch contact section 12 which rests on a latch 14. The latch may be made of a wide range of materials including plastics, metals, and composites. Although the latch 14 may pivot downwards without concurrent upwards movement the handle 10, any upwards movement of the handle 10 will cause a concurrent downward pivot in the leading edge 16 of the latch 14. In some embodiments, the latch is biased towards a horizontal position, in which the leading edge is engaged with a catch 18 in the cabinet frame 20, by a spring 22, positioned between an inside front wall 21 of the drawer and the latch 14. In embodiments including a biasing spring 22, the latch 14 may include a spring seat 24 to securely hold the spring 22. In one embodiment end caps 26 are used to seal the end of the handle's channel and for decorative purposes. End caps 26 are attached to the end of each handle 10 to retain and protect the moving parts explained above and center each assembly on the drawer. End caps 26 according to one embodiment of the present invention manufactured from plastic or other suitable material. The end cap 26 is attached, in various embodiments with mechanical, or other suitable, fasteners into the provided channels 42 in the handle.

In one embodiment, the catch 18 is a formed tab manufactured into the drawer slide hanger. The catch 18 should not be limited to an integrated form. The catch 18 may be a separate piece that can be attached by any secure means such as: welding, gluing, threaded fasteners and/or a non-threaded fastener such as a riveting operation. The catch 18 provides a striker for the latch 14 to tumble down and under, and then hook its self onto. The catch 18 may take the form of any shape so to provide a body for which the latch 14 can tumble down, under and across the inclined plane of the latch. The catch 18 may be produced from any number of manufacturing operations including, but not limited to: extrusions, milling, bending, forming or a protruding fastener. Furthermore, the material may be but is not limited to: plastics and any number of different metals.

Similarly in one embodiment of the present invention, the latch 14 engages the catch 18 in a dog or tumbling action. The latch 14 is self-guided, by inclined planes, so when the drawer is pushed closed, each latch 14 acts independently of one another, without the use or action of the handle, will tumble down and under the lance. Once the drawer 30 is pushed far enough in and into a closed position, the latch 14 then engages the catch 18 and retains the drawer closed. The latch 14 is, in one embodiment, an injected molded part but is not limited to this manufacturing process or material. The latch 14 pivots on the handle rather than from the supports 40. The channel 42 in which the handle 10 pivots on the supports 40 is the same channel 42 in which the latch 14 pivots.

In one embodiment, a pre-loaded spring 22 is provided which preloads or biases the latch 14 and the handle 10 in the closed position. In one embodiment, each latch 14 has a bucket or seat built into the body of the latch 14, that faces the inside front face of the drawer 30. This face is also the surface which interacts with the spring 22 to apply force to the latch 14, to which the latch 14 then acts upon the handle 10 and preloads or biases the handle 10 in the closed position.

Figure 2:
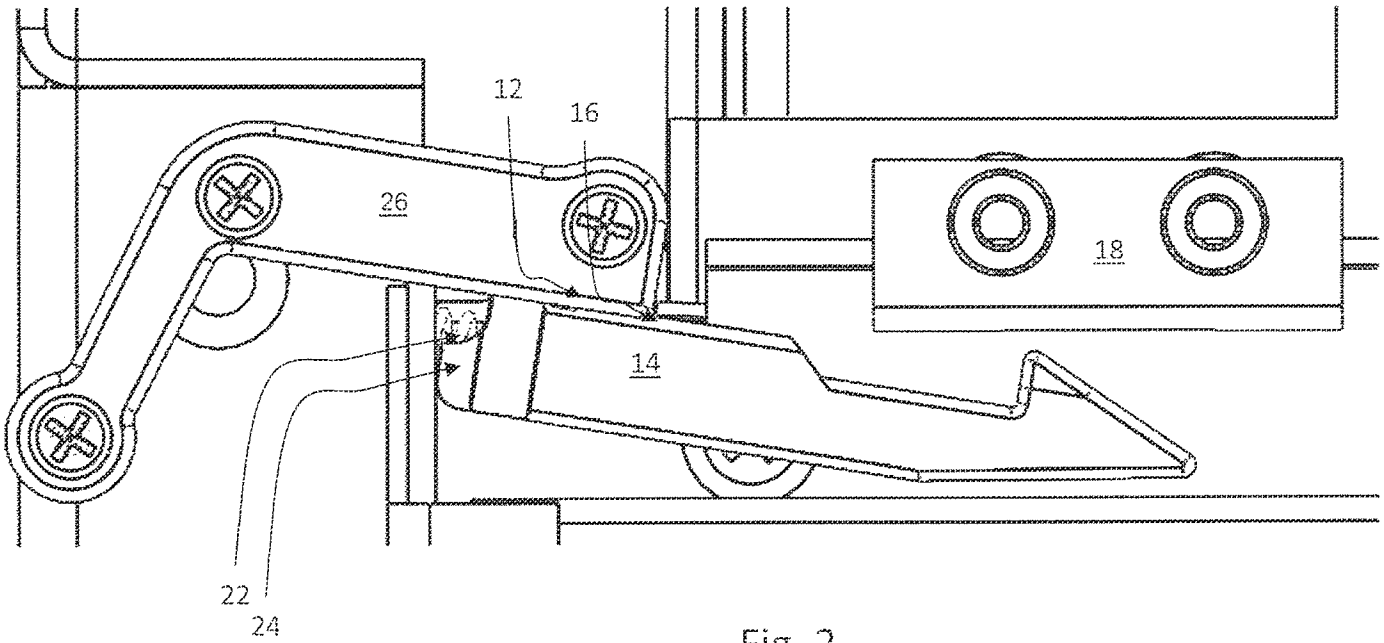
FIG. 2 is a side partial section view of one end of the latching mechanism in an open position, configured in accordance with one embodiment of the present invention.
Figure 3A:
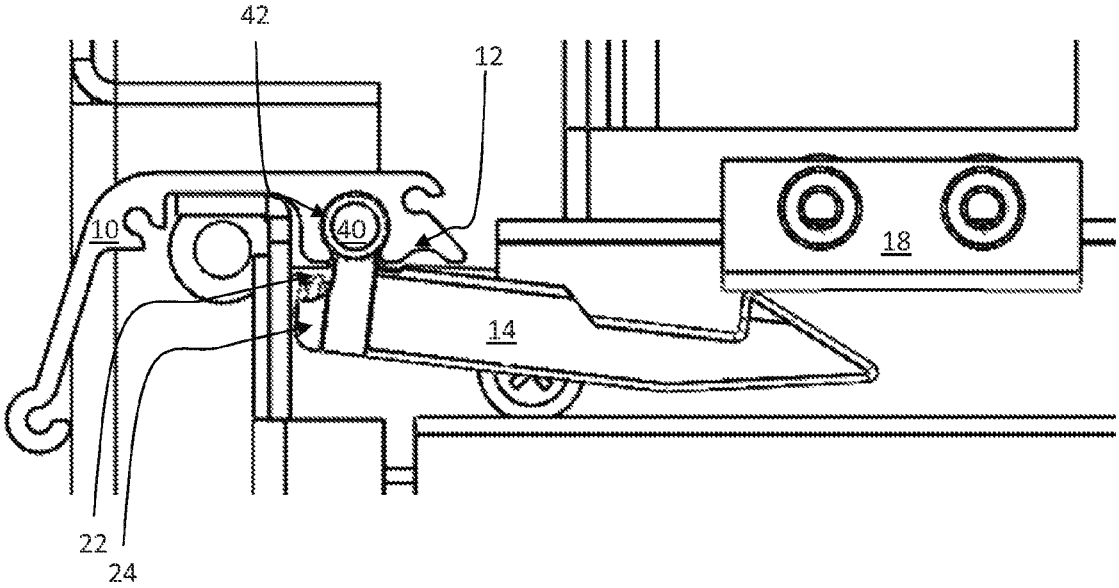
FIG. 3A is a side partial section view of one end of the latching mechanism, configured in accordance with one embodiment of the present invention, where the latch is being forced under the catch by the drawer being closed, without the use of the handle.
Figure 3B:
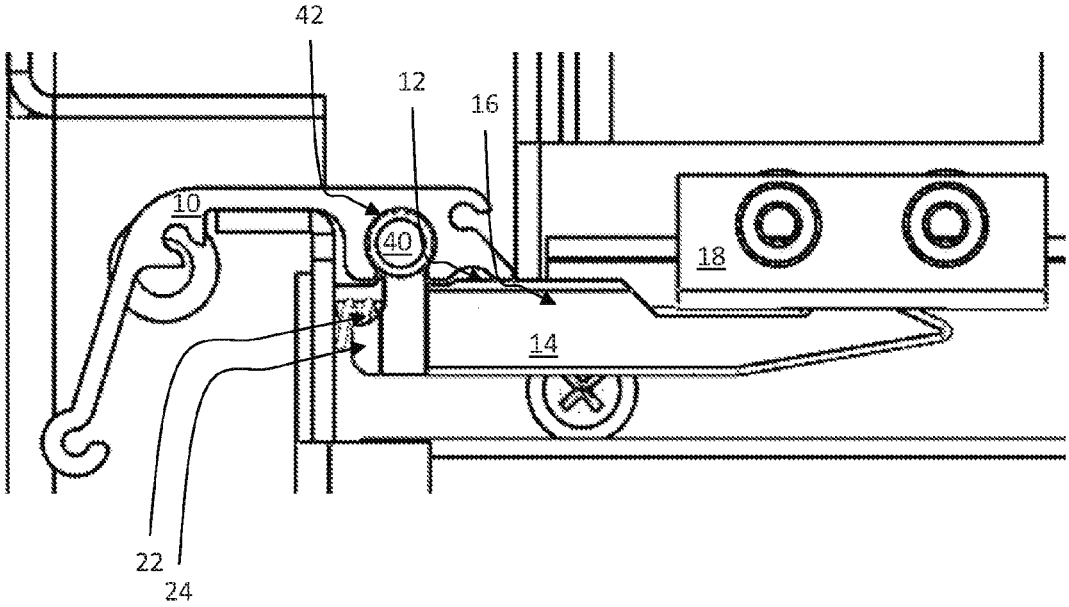
FIG. 3B is a side partial section view of one end of the latching mechanism, configured in accordance with one embodiment of the present invention, where the latch is engaging the catch by the drawer being closed, without the use of the handle.
Figure 3C:
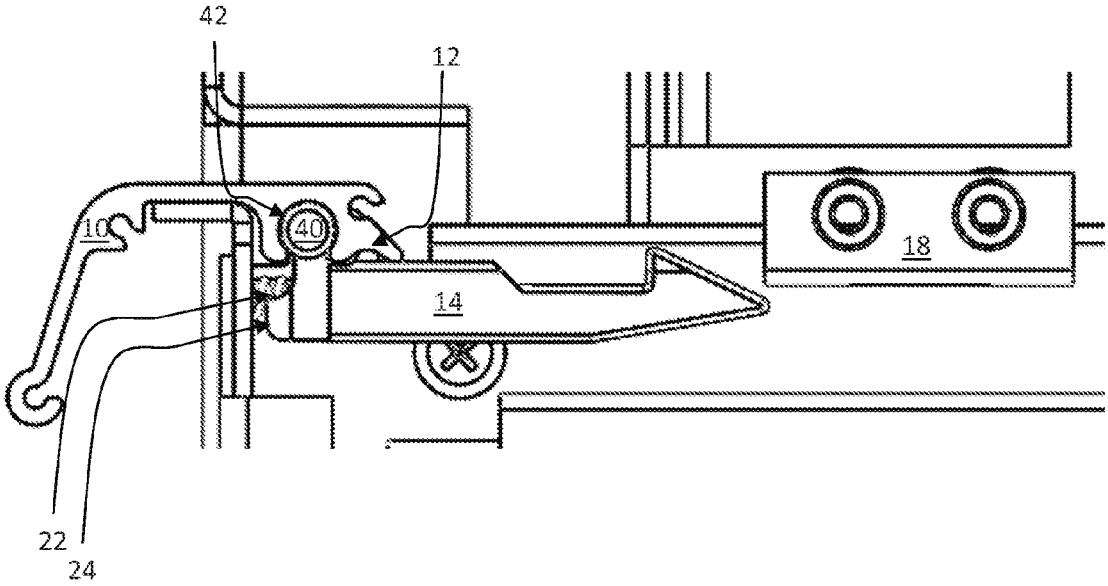
FIG. 3C is a side partial section view of one end of the latching mechanism, configured in accordance with one embodiment of the present invention, where the draw is in an open position.
Figure 3D:
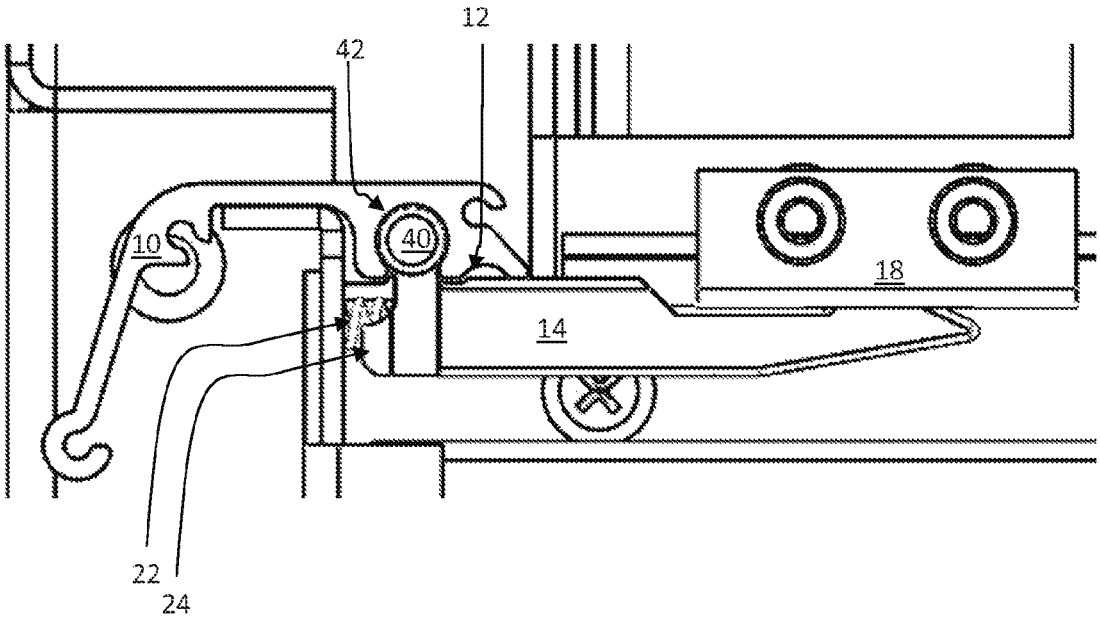
FIG. 3D is a side partial section view of one end of the latching mechanism, configured in accordance with one embodiment of the present invention, where the draw is in a closed position with the end cap removed.
Figure 4:
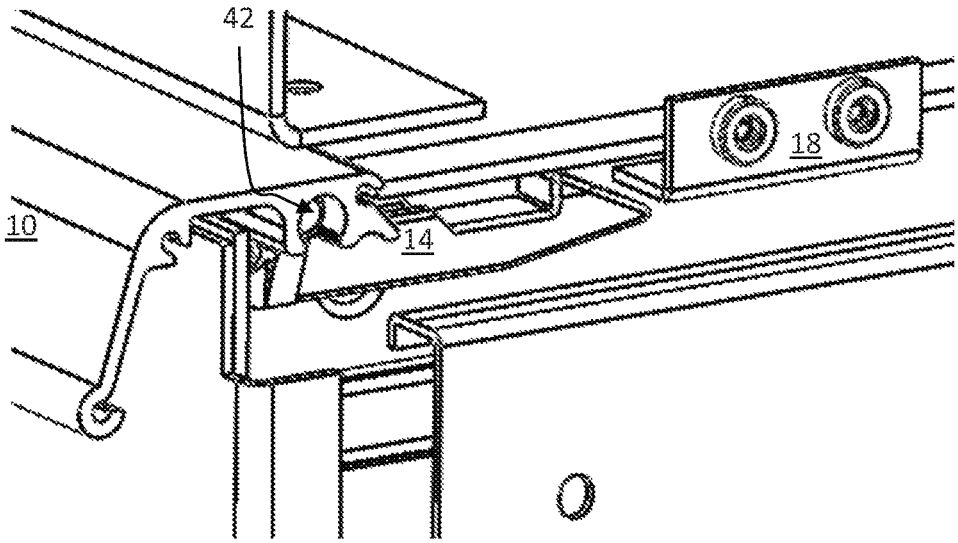
FIG. 4 is a perspective view of one end of the latching mechanism, configured in accordance with one embodiment of the present invention.

Referring to FIG. 2, the latching mechanism has been moved to an open position by upward rotation of the handle 10. This movement of the handle 10 has forced the applied pressure forward of the pivot point of the latch 14, forcing its leading edge 16 under the catch 18.

Referring to FIG. 3A-D, the latch 14 can be seen in the open position, sliding under the catch 18, while the handle 10 remains in the closed position. This occurs when the drawer 30 is closed by the user. The latch leading edge 16 is tapered in some embodiments to facilitate its sliding under the catch 18. Once the latch 14 clears the catch 18, it will rotate back to a horizontal position, engaging the catch 18. In some embodiments a spring 32 may be used to bias the latch 14 towards the desired horizontal position.

Referring to FIGS. 3-5A, a support 40 is visible in rotatable engagement with a channel 42 in the handle 10. The latch 14 can also be seen to be in rotatable engagement with this channel 42. The support or pedestal 40 provides a fulcrum point on which the handle can pivot. Supports 40, in one embodiment, are individual pieces fastened to the inside front face of the drawer basin 30. In one embodiment, fastening method may be a threaded fastener of any sort. Welds, rivets, and other permanent fastening techniques can also be used in alternative embodiments. In one embodiment, each support 40 is mounted independently of one another. The quantity of supports 40 needed varies according to width of the drawer 30. In one embodiment, a minimum of two supports 40 per assembly is used but is unrestricted to the amount needed, as each assembly's handle could be cut to any custom length to achieve an infinite number of drawer widths. The support 40 interacts with the handle 10 (lever), inward of each edge. When the handle 10 is pulled up to open the drawer 30, the latch 14 is acted upon by the handle 10 and rotates down.

Figure 5A:
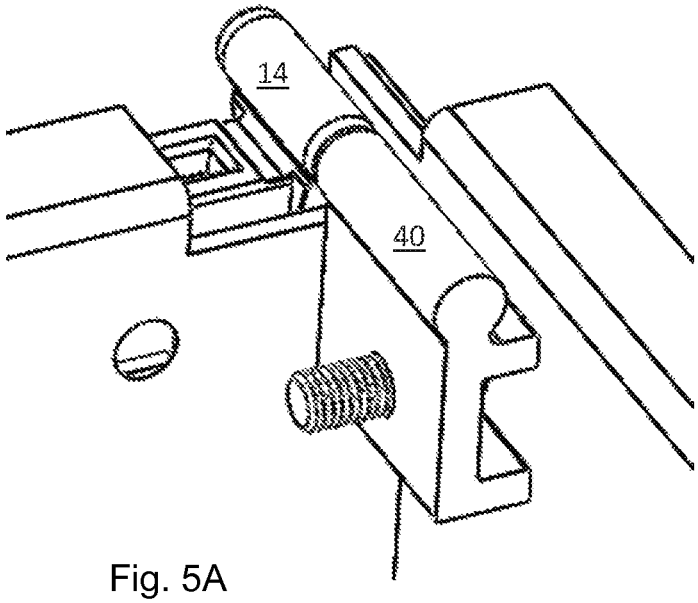
FIG. 5A is a perspective view of one end of the latching mechanism with handle removed to illustrate the alignment of the supports and latch, configured in accordance with one embodiment of the present invention.
Figure 5B:
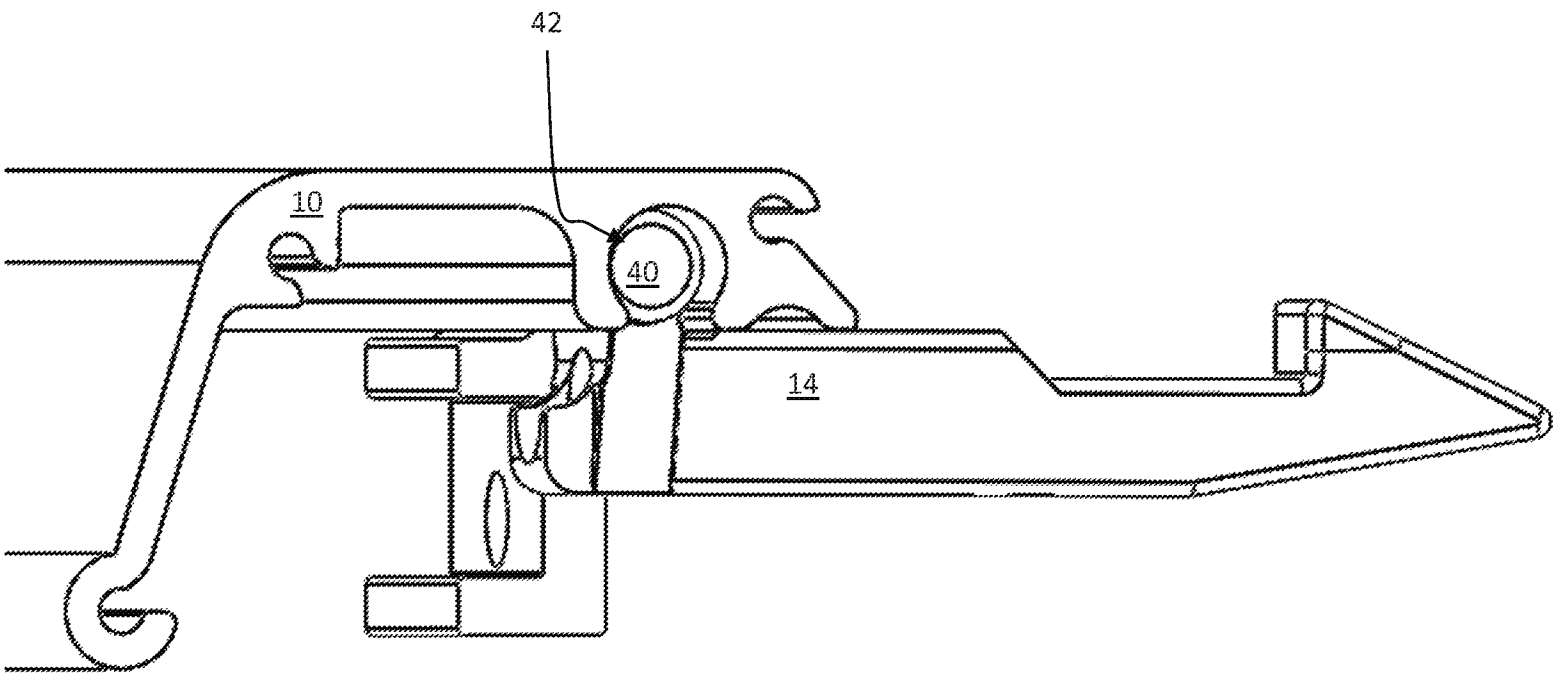
FIG. 5B is a perspective view of one end of the latching mechanism with the end caps omitted, configured in accordance with one embodiment of the present invention.

Referring to FIG. 5A-B, the channel 42 in the handle 10 can clearly be seen with the end cap 26 omitted. The latch 14 and support 40 are rotatably fixed within this channel.

In one embodiment of the present invention for a sliding drawer assembly is provided which includes a latch mechanism for securing the drawer, comprising: a cabinet frame 20; the drawer is slidably coupled to the cabinet frame 20, the drawer having a front wall 21 and draw shelf; at least two supports 40 fixed to the drawer, abutting the drawer's front wall 21, providing pivotal connections for rotation about an axis substantially parallel with the drawer front 21; a handle 10 having a channel 42 in rotatable communication with the supports' 40 pivotal connections and a latch contact section 12 extending from the channel 42, away from the drawer front wall 21, and substantially parallel to the drawer shelf in an unrotated position; a latch 14 having a pivotal connection, a top portion 16, and extending substantially parallel to the drawer shelf, the pivotal connection in rotatable communication with the handle's channel 42 and coaxial with the supports' pivotal connection 40, the top portion 16 of the latch 14 being in communication with the latch contact section 12; and a catch 18, disposed in the cabinet frame 20, able to provide releasable engagement with the latch.

In one such embodiment of the present invention provides such a latch 14 with a tapered leading end 16 or curved end 16. In some embodiments a spring member 22 may be disposed between the front wall and the latch, biasing the handle and the latch 14 towards a closed position. In such embodiments, the spring member 22 is selected from the group of spring members comprising pre-loaded springs, springs, extension springs, polymeric pads or bumpers, tangs, leaf springs.

The latch may use a spring seat 24 disposed on the latch and facing the front drawer wall. At least two end caps 26 fixed within the handle's channel 14 at opposite ends of the handle 10. The end caps 26 can be fixed to the handle's channel by threaded fasteners. The top section of the latch 16 can be flat or curvilinear or a cam.

An embodiment of the present invention provides a latch system, the latch system comprising: at least two supports 40 providing pivotal connections for rotation about an axis; a handle 10 having a channel 42 in rotatable communication with the supports' 40 pivotal connections and a latch contact section 12 extending from the channel 42; a latch 14 having a pivotal connection, a top portion 16, and the pivotal connection in rotatable communication with the handle's channel 42 and coaxial with the supports' 40 pivotal connection, the top portion 16 of the latch 14 being in communication with the latch contact section 12; and a catch 18, mounted externally to the latch system, able to provide releasable engagement with the latch 14. The leading ends 23 can be tapered or curved. A spring member 22 can be used to bias the handle 10 and the latch 14 towards a closed position. End caps 26, possibly two, can be fixed within the handle's channel 42 at opposite ends to close the channel 42 and may be fixed by threaded fasteners. In one embodiment, the top 16 of the latch may have different shapes, and act as a cam, but flat or curved.

The foregoing description of the embodiments of the invention has been presented for the purposes of illustration and description. It is not intended to be exhaustive or to limit the invention to the precise form disclosed. Many modifications and variations are possible in light of this disclosure. It is intended that the scope of the invention be limited not by this detailed description, but rather by the claims appended hereto.

That which is claimed is:

1. A sliding drawer assembly including a latch mechanism for securing a drawer, comprising:

a cabinet frame;

a drawer slidably coupled to the cabinet frame, the drawer having a front wall;

at least two supports fixed to the drawer, affixed to the drawer's front wall, providing pivotal connections for rotation about an axis substantially parallel with the front wall;

a handle having a channel in rotatable communication with the supports' pivotal connections and a latch contact section extending from the channel, away from the drawer front wall, and substantially perpendicular to a plane of the front wall when said handle is in an unrotated position;

a latch having a pivotal connection, a top portion, and extending substantially perpendicular to a plane of the front wall when said latch is in an unrotated position, the pivotal connection in rotatable communication with the handle's channel and coaxial with the supports' pivotal connection, the top portion of the latch being in communication with the latch contact section said latch not being directly connected to either of said supports; and a catch, disposed in the cabinet frame, able to provide releasable engagement with the latch.

2. The sliding drawer assembly of claim 1, wherein the latch includes tapered leading ends.

3. The sliding drawer assembly of claim 1 wherein the latch includes curved ends.

4. The sliding drawer assembly of claim 1, further comprising a spring member between the front wall and the latch, biasing the handle and the latch towards a closed position.

5. The sliding draw assembly of claim 4, wherein said spring member is selected from the group of spring members comprising pre-loaded springs, springs, extension springs, polymeric pads or bumpers, tangs, leaf springs.

6. The sliding drawer assembly of claim 4, wherein the latch incorporates a spring seat facing the front drawer wall.

7. The sliding drawer assembly of claim 4, wherein end caps are fixed to the handle's channel by threaded fasteners.

8. The sliding drawer assembly of claim 1, further comprising at least two end caps fixed within the handle's channel at opposite ends.

9. The sliding drawer assembly of claim 1 wherein said top portion of said latch is substantially flat.

10. The sliding drawer assembly of claim 1 wherein said top portion of said latch is curvilinear.

11. The sliding drawer assembly of claim 1 wherein said top portion comprises a cam.

12. A latch system, said latch system comprising:

at least two supports providing pivotal connections for rotation about an axis;

a handle having a channel in rotatable communication with the supports' pivotal connections and a latch contact section extending from the channel;

a latch having a pivotal connection, a top portion, and the pivotal connection in rotatable communication with the handle's channel and coaxial with the supports' pivotal connection, the top portion of the latch being in communication with the latch contact section; said latch not being directly connected to either said support; and a catch, mounted externally to the latch system, able to provide releasable engagement with the latch.

13. The latch system of claim 12, said latch further comprising tapered leading ends.

14. The latch system of claim 12 further comprising curved leading ends.

15. The latch system of claim 12 further comprising a spring member biasing the handle and the latch towards a closed position.

16. The latch system of claim 12 further comprising at least two end caps fixed within the handle's channel at opposite ends.

17. The latch system of claim 16 wherein the end caps are fixed to the handle's channel by threaded fasteners.

18. The latch system of claim 12 wherein said latch top comprises a cam.

* * * * *